United States Patent [19]

Batteux et al.

[11] Patent Number: 4,883,931

[45] Date of Patent: Nov. 28, 1989

[54] HIGH PRESSURE ARC EXTINGUISHING CHAMBER

[75] Inventors: Pierre Batteux, Vizille; Jean-Pierre Nereau, La Tronche, both of France

[73] Assignee: Merlin Gerin, Grenoble Cedex, France

[21] Appl. No.: 206,132

[22] Filed: Jun. 13, 1988

[30] Foreign Application Priority Data

Jun. 18, 1987 [FR] France ..... 8708583

[51] Int. Cl.[4] ..... H01H 33/70

[52] U.S. Cl. ..... 200/148 R; 200/148 A; 200/148 B; 200/150 C; 200/147 R

[58] Field of Search ..... 200/144 R, 147 R, 148 A, 200/148 R, 148 B, 150 B, 150 C

[56] References Cited

U.S. PATENT DOCUMENTS 4,700,028 10/1987 Heyde ..... 200/150 C

FOREIGN PATENT DOCUMENTS 794204 4/1958 United Kingdom ..... 200/150 C

*Primary Examiner*—Robert S. Macon

*Attorney, Agent, or Firm*—Arnold, White & Durkee

[57] ABSTRACT

An arc extinguishing chamber for an electrical switchgear device, notably a circuit breaker or a current limiting unit, comprises an almost tightly sealed case made of gas-producing insulating material to house separable contacts with electrodynamic repulsion. The movable contact, in the shape of a bridge, appreciably follows the internal configuration of the case playing the role of a piston arranged on both sides of a first compartment generating pressure due to the action of the arc, and a second compartment communicating with the first via a minimal clearance J. The pressure in the second compartment is lower than that in the first compartment. Magnetic circuits can be arranged to accelerate the movable contact to the open position.

6 Claims, 3 Drawing Sheets

HIGH PRESSURE ARC EXTINGUISHING CHAMBER

BACKGROUND OF THE INVENTION

The invention relates to an arc extinguishing chamber for an electrical switchgear device, notably a circuit breaker or a current limiting unit, comprising:

a system of stationary and movable contacts, housed inside an almost tightly sealed case made of insulating material, the movable contact being biased to the open position by the pressure generated by the arc drawn between the contacts after separation, a compression piston separated from the walls of the case by a predetermined clearance J subdividing the internal volume of the case into a first compartment generating pressure due to the action of the arc, and a second compartment communicating with said first compartment via the clearance J, the volumes of the two elementary compartments varying inversely with one another when movement of the movable contact occurs.

In a device of this nature, electric arc extinction is not achieved by deionization by means of stacked metal separators, but results from the pressure generated by the arc itself. According to the document EP-A-No. 87642, separation of the contacts is accomplished by the action of an excitation coil arranged coaxially around the contacts and inserted in series electrically with the latter. The movable contact is made of magnetic material, and the case comprises a plurality of exhaust slots designed to reduce the pressure inside the case.

The object of the invention consists in making a high pressure arc extinguishing chamber for a low voltage switchgear device easier to achieve.

SUMMARY OF THE INVENTION

The chamber according to the invention is characterized by the following features:

the movable contact appreciably follows the internal configuration of the case playing the role of said piston, and the loop arrangement of said contacts forms high-speed opening means by electrodynamic repulsion taking place as soon as a short-circuit current occurs followed by the piston effect of the movable contact by the pressure generated by the arc.

The pressure in the second compartment is lower than that generated by the arc in the first compartment during the extinction phase.

In order to enable the movable contact to fulfill its piston role, the clearance between the movable contact and the chamber must be minimum. This results in the creepage section SF arranged between the two compartments having to be appreciably lower than the movable contact section SC. The creepage section SF is defined by the clearance J between the case and the periphery of said movable contact, the sections SC and SF being measured in a plane perpendicular to the direction of movement of the movable contact.

According to a first embodiment, the bridge-shaped movable contact moves in translation inside the chamber, and the bridge is securedly united to an actuating rod passing through the wall of the case via an opening located on the second compartment side.

Magnetic circuits can be associated with the chamber to strengthen the magnetic field, and accelerate the movable contact towards the open position.

According to a second embodiment, the movable contact with double electrodynamic repulsion is mounted with limited rotation on a shaft, and comprises an intermediate boss in the form of a knee-joint designed to cooperate with the internal wall of the case to preserve the tightness between the elementary compartments of the chamber.

BRIEF DESCRIPTION OF THE DRAWINGS

Other advantages and features will become more clearly apparent from the following description of a various illustrative embodiments of the invention, given as non-restrictive examples only and re in the accompanying drawings, in which.

DESCRIPTION OF THE PREFERRED EMBODIMENT

Figure 1:
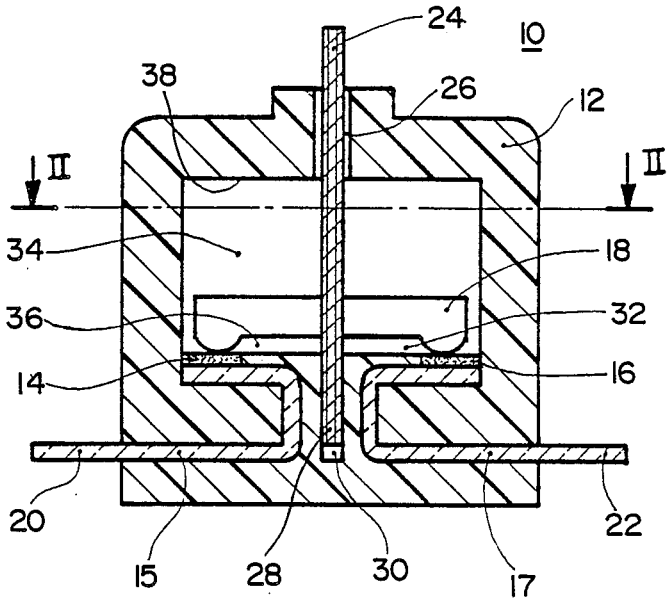
FIG. 1 is a schematic sectional view of an arc extinguishing chamber according to the invention.
Figure 2:
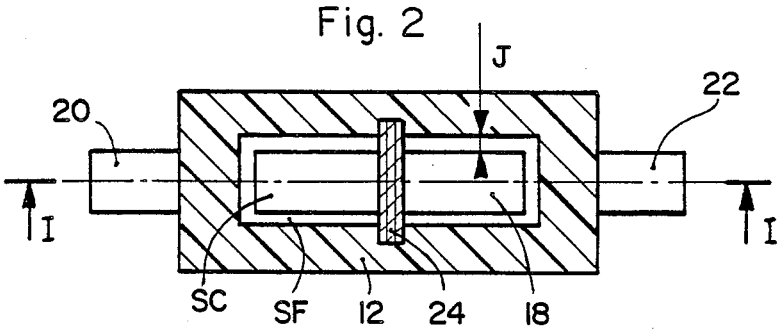
FIG. 2 is a sectional view along the line II—II of FIG. 1.

In FIGS. 1 and 2, an arc extinguishing chamber 10 of an electrical switchgear device comprises a case 12 made of gas-producing insulating material housing a pair of stationary contacts 14, 16 cooperating in the closed position of the switchgear device with a movable contact 18 in the shape of a bridge. Each stationary contact 14, 16 is supported by a current carrying conductor 15, 17 embedded in the wall of the case 12 and terminated by a terminal connection pad 20, 22. The movable contact 18 in translation is coupled to an insulating operating rod 24, which passes with limited clearance through the case 12 via an opening 26. The extension of the operating rod 24 is equipped with a positioning lug 28 capable of sliding in a blind guiding groove 30 arranged in the case 12 extending axially in the first compartment 32. The structure of the chamber 10 is symmetrical with respect to the axial mid-plane passing through the rod 24. The rod 24 is connected to an operating mechanism (not shown). The chamber 10 is almost tightly sealed, given that the internal volume communicates with the outside via the small gap existing between the opening 26 and the rod 24. The movable contact bridge 18 appreciably follows the internal configuration of the case 12, and plays the role of a moving piston separating the chamber 10 into two elementary zones or compartments 32, 34, having different pressures in the arc extinguishing phase. The first lower zone 32 is bounded between the bridge 18 and the base 36 acting as support for the stationary contacts 14, 16. The arc originates in the first zone 32, and reacts with the gas-producing material of the case 12, to generate a pressure capable of accelerating the movement of the movable contact 18 towards the open position.

The second upper zone 34 of the chamber 10 is bounded between the bridge, opposite the contact parts cooperating with the corresponding stationary contacts 14, 16, and the upper internal face 38 of the case 12 in which the central opening 26 is located through which the operating rod 24 passes. The volumes of the two elementary zones 32, 34 vary inversely to one another when the movable contact 18 moves in translation, and the gap between the rod 24 and the opening 26 acts as communication means of the second zone 34 with the external surroundings. The small size of the gap however enables leaks to the outside to be minimized.

To obtain a high arc voltage without using metal separators, the pressure generated inside the chamber 10 must be as high as possible to interrupt the arc quickly. The internal pressure naturally depends on the intensity of the current flowing through the pole, and can reach a peak value of more than 100 bars when the creepage section SF which takes into account the mean clearance J between the bridge and the four internal walls between the two zones 32, 34 of the case 12, is smaller than the section SC of the movable contact 18 (see FIG. 2), said sections SF and SC being measured in a plane perpendicular to the direction of movement of the movable contact 18. This results in the clearance J having to have a minimum value, just sufficient to allow movement of the movable contact 18 without friction inside the chamber 10. As an example for a 63A rating circuit breaker, the contact section SC is 90 sq.mm for a creepage section SF of 40 sq.mm between the two zones 32 and 34.

An arc extinguishing chamber 10 of this kind can be incorporated in a low voltage circuit breaker, with limiting effect or not, a contactor or a current limiting unit.

Operation of the arc extinguishing chamber 10 according to FIGS. 1 and 2 is as follows:

when movement of the movable contact 18 is controled by the operating rod 24 of the mechanism, for example when an overload current flows in the pole detected by the trip device, separation of the contacts 14, 16, 18 generates an arc in the first zone 32. The pressure generated by the arc is sufficient to cause self-extinction of the arc.

In the case of a short-circuit current, the initial movement of the movable contact 18 is derived from the electrodynamic repulsion resulting from the loop arrangement of the contacts 14, 16, 18. The arc drawn between the contacts causes a pressure increase in the first zone 32 which propels the movable contact 18 to the open position before the mechanism operates.

In the closed position (FIG. 1), the volume of the compartment 32 is minimum, whereas that of the upper compartment 34 is maximum. In the open position, the compartment 32 has a maximum volume, and that of the compartment 34 is practically reduced to zero.

It can be noted that the pressure in the chamber 10 is used to improve the dielectric strength between the separated contacts, and to increase the speed of separation of the contacts enabling a high arc voltage favorable for arc extinction to be obtained quickly.

Figure 3:
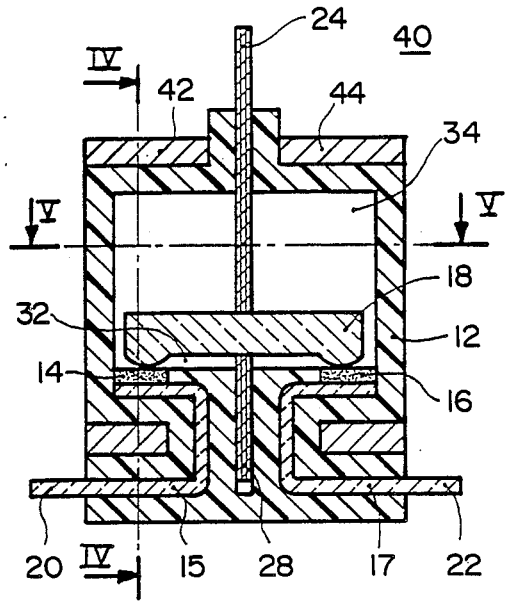
FIG. 3 shows an identical view to FIG. 1 of an alternative embodiment.
Figure 4:
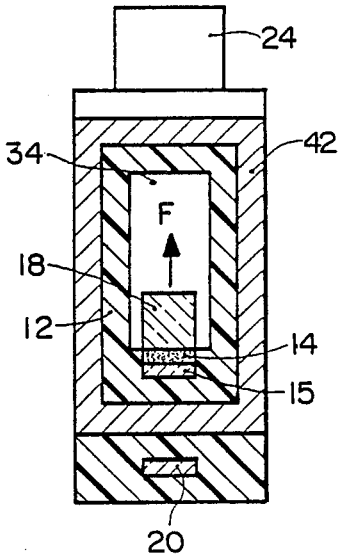
FIGS. 4 and 5 represent respectively sectional views along the lines IV—IV and V—V of FIG. 3.
Figure 5:
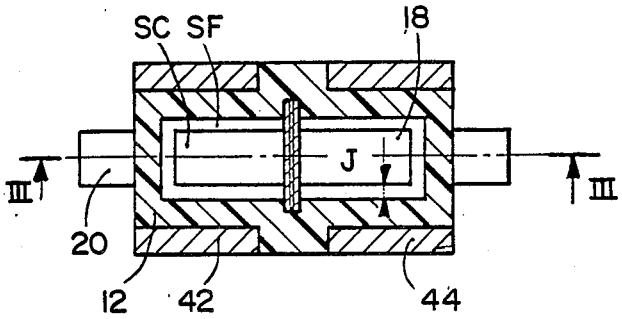

In the arc extinguishing chamber 40 in FIGS. 3 to 5, the same reference numbers are used to designate identical parts to those of the device in FIGS. 1 and 2. The chamber 40 comprises in addition two magnetic circuits 42, 44 in the form of rectangular frames surrounding the interruption zones in such a way as to take part in accelerating the movable contact 18 to the open position (see arrow F, FIG. 4).

Movement of the movable contact 18 thus results from the pressure generated inside the chamber 40, and from the interaction of the magnetic field on the current flowing in the movable contact 18. The field is strengthened by the presence of these two magnetic circuits 42, 44 arranged on both sides of the rod 24.

Figure 6:
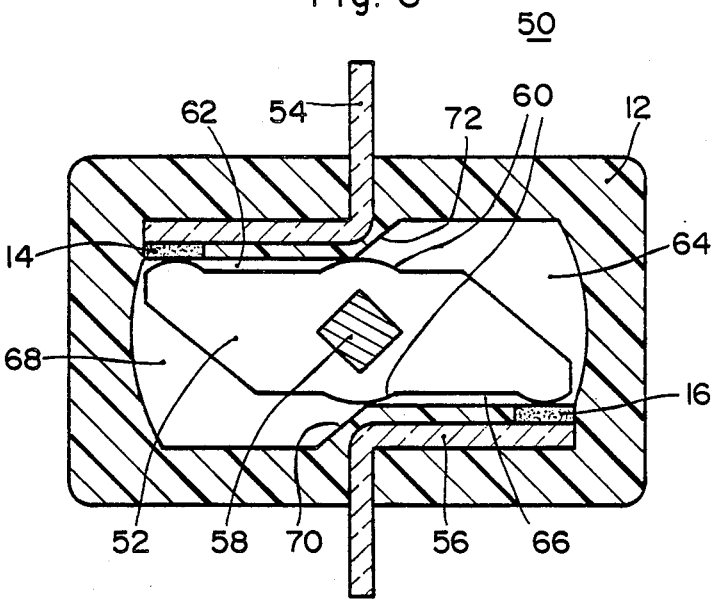
FIGS. 6 and 7 show sectional views of another alternative embodiment of the chamber, respectively in the closed and open positions of the contacts.
Figure 7:
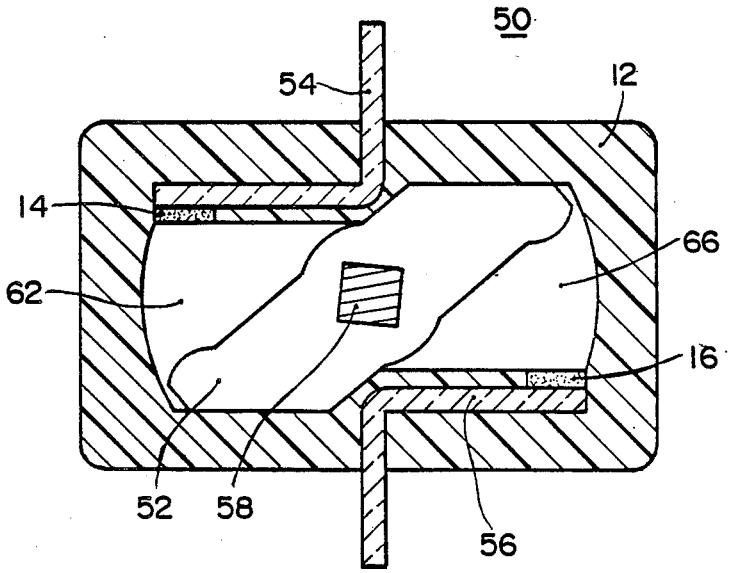

In the alternative embodiment in FIGS. 6 and 7, the arc extinguishing chamber 50 is equipped with a double rotating contact 52 housed inside a sealed case 12. Each stationary contact 14, 16 is supported by a bracket-shaped current carrying conductor 54, 56, and the movable contact 52 is mounted on a central control shaft 58. The intermediate periphery of the movable contact 52 is provided with a double boss 60 in the form of a knee-joint designed to cooperate with the internal wall of the case 12 to preserve the tightness between the different compartments 62, 64; 66, 68 of the chamber 50. The movable contact 52 follows the internal shape of the case 12 with the clearance J interposed, and the compartments 62 and 66 located respectively between the stationary contacts 14, 16 and the movable contact 52 are the seat of the pressure increase due to the presence of the arc when the switchgear device breaks. The movable contact 52 plays the role of a double rotating piston controled by the shaft 58 and by the pressure generated in the compartments 62 and 66. In the open position (FIG. 7), the volume of the compartments 62, 66 is maximum, and the volume of the compartments 68, 64 is cancelled by the maximum rotation of the movable contact 52 coming up against the stops 70, 72 of the case 12.

The insulating material of the case 12 is polymer-based, but it is clear that it could be made of another less gas-producing material. In this case, arc guiding flanges of a material having gas-producing properties can be incorporated in the case 12 at the level of the arc formation zone. In FIGS. 1 to 7, the contact pressure springs have not been represented.

I claim:

1. An arc extinguishing chamber for an electrical switchgear device, notably a circuit breaker or a current limiting unit, comprising:

a system of stationary and movable contacts, housed inside an almost tightly sealed case made of insulating material, the movable contact being biased to the open position by the pressure generated by the arc drawn between the contacts after separation, a compression piston separated from the walls of the case by a predetermined clearance J subdividing the internal volume of the case into a first compartment generating pressure due to the action of the arc, and a second compartment communicating with said first compartment via the clearance J, the volumes of the two elementary compartments varying inversely to one another when movement of the movable contact occurs, the movable contact appreciably following the internal configuration of the case playing the role of said piston, and high-speed opening means by electrodynamic repulsion resulting from the loop arrangement of said contacts, said repulsion taking place as soon as a short-circuit current occurs followed by the piston effect of the movable contact by the pressure generated by the arc.

2. An arc extinguishing chamber according to claim 1, wherein the pressure in the second compartment is lower than that generated by the arc in the first compartment during the extinction phase, said case including a creepage section SF arranged between the first and second compartments and defined by a clearance J between the case and the periphery of the movable contact, the creepage section being smaller than a section SC of the movable contact, the sections SC and SF being measured in a plane perpendicular to the movement of the movable contact.

3. An arc extinguishing chamber according to claim 1, wherein the movable contact moves in translation inside the chamber, and includes a bridge contact which is securedly united to an actuating rod passing through the wall of the case via an opening located on the second compartment side.

4. An arc extinguishing chamber according to claim 3, wherein the operating rod is equipped with a positioning lug capable of sliding in a conjugate guiding groove opening into the first compartment.

5. An arc extinguishing chamber according to claim 1, wherein each contact separation zone is surrounded by a magnetic circuit strengthening the magnetic field to accelerate the movable contact to open position.

6. An arc extinguishing chamber according to claim 1, wherein the movable contact is mounted on a rotatable shaft, and comprises an intermediate boss in the form of a knee-joint cooperating with an internal wall of the case to preserve the tightness between the elementary compartments of the chamber.

* * * * *